US005941004A

United States Patent [19]

Pedersoli

[11] Patent Number: 5,941,004

[45] Date of Patent: Aug. 24, 1999

[54] MUZZLE-LOADING RIFLES AND BREECH-LOADING RIFLES

[75] Inventor: Pierangelo Pedersoli, Sarezzo, Italy

[73] Assignee: Pedersoli Davide & C. di Pedersoli S.N.C. Pierangelo E Silvana, Gardone V.T., Italy

[21] Appl. No.: 08/984,266

[22] Filed: Dec. 3, 1997

[51] Int. Cl.[6] ..... F41C 7/06; F41A 3/58

[52] U.S. Cl. ..... 42/51; 42/2

[58] Field of Search ..... 42/51, 16, 20, 42/25, 69.01, 69.02, 69.03, 28, 26; 89/1.3

[56] References Cited

U.S. PATENT DOCUMENTS

| | | | |
|---|---|---|---|
| 38,366 | 5/1863 | Albright | 42/32 |
| 190,820 | 5/1877 | Chapman | 42/32 |
| 207,689 | 9/1878 | Soper | 42/32 |
| 1,405,765 | 2/1922 | Diehm | 42/20 |
| 2,147,185 | 2/1939 | Ahern | 42/16 |
| 2,499,379 | 3/1950 | Garrett | 42/20 |
| 2,775,835 | 1/1957 | Gaidos | 42/16 |
| 2,967,367 | 1/1961 | Ivy | 42/16 |
| 3,142,923 | 8/1964 | Vartanian et al. | 42/25 |
| 3,142,924 | 8/1964 | Ruger et al. | 42/32 |
| 3,398,476 | 8/1968 | Hoving | 42/16 |
| 4,272,902 | 6/1981 | Waters | 42/25 |
| 4,416,077 | 11/1983 | Thompson | 42/25 |
| 5,519,955 | 5/1996 | Peifer | 42/51 |
| 5,718,073 | 2/1998 | Sachse et al. | 42/51 |

*Primary Examiner*—Charles T. Jordan
*Assistant Examiner*—Denise J. Buckley
*Attorney, Agent, or Firm*—McGlew & Tuttle, P.C.

[57] ABSTRACT

A muzzle-loading or breech-loading rifle which comprises a bolt (27), which is mounted, rotating, on the rear of the receiver casing of the barrel and rotates between a position of opening and one of closing. In the bolt is mounted a percussion means (30), which is arranged in line with the barrel when the bolt is in the position of closing. A cocking mechanism (25) is mounted in the receiver casing (21') in parallel with the said barrel and turned towards the percussion means (30) when this is in line with the barrel.

18 Claims, 5 Drawing Sheets

MUZZLE-LOADING RIFLES AND BREECH-LOADING RIFLES

FIELD OF THE INVENTION

The present invention pertains to muzzle-loading rifles and breech-loading rifles.

BACKGROUND OF THE INVENTION

Muzzle-loading rifles are generally reproductions of rifles of former times. They are usually reproductions which are true to the original; however, the increase made in the U.S.A. and Canada in the sport of hunting, which might use muzzle-loading guns, has caused a new type of such guns to come about, which might not have any link to the old guns except for the manner of loading and the ammunition. Such guns are the conversion into muzzle-loading of breech-loading models that are usually known by the term Bolt Action, and as such, they usually have a cocking and closing mechanism with straight-line motion in the rear zone of the barrel. For this purpose, the barrel proves to be relatively long and it has an opening on top or on the side for the access to the so-called wick holder and the insertion of the trigger cap for igniting the load in the barrel.

However, the access to the wick holder is narrow and awkward, which limits the freedom of maintenance and polishing of the parts involved as well, which are fundamental actions when black powder, which is necessary for muzzle-loading guns, is used.

Beyond its appearance in terms of aesthetics, the breech-loading rifles do have cocking mechanisms and systems for closing the barrel in the receiver which are completely different from those of the muzzle-loading rifles.

SUMMARY AND OBJECTS OF THE INVENTION

The primary object of the present invention is to propose a novel muzzle-loading rifle, which is simplified in terms of its firing mechanism, opening and closing and access to the wick holder, with the advantages of a reduction in the length of the barrel and of an easier and more convenient insertion of the trigger cap, besides an easy disassembly of same for maintenance and polishing.

Another object of the present invention is to provide a new muzzle-loading rifle, whose general structure may also be used for setting up a breech-loading rifle with a simple addition of functional elements, such as a firing pin and an extractor for the fired cartridge, besides a suitable cartridge chamber.

According to the invention, a muzzle-loading or breech-loading rifle is provided including a body with a butt. A barrel is provided having a receiver casing fixed to the body. An opening and closing bolt for loading and firing the gun, respectively, a percussion means at the level of the barrel to produce the firing, a firing device with at least one said trigger fixed to the receiver casing and a cocking mechanism cooperating with the said firing device for its stop in the cocking position and its release in order to control the said percussion means for firing is also provided. The bolt is mounted rotating on the rear of the receiver casing and rotates between the positions of opening and closing. The percussion means is mounted in the bolt and is arranged in line with the barrel when the bolt is in the position of closing. The cocking mechanism is mounted in the receiver casing in parallel with the barrel and turned towards the percussion means when this percussion means is in line with the barrel.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
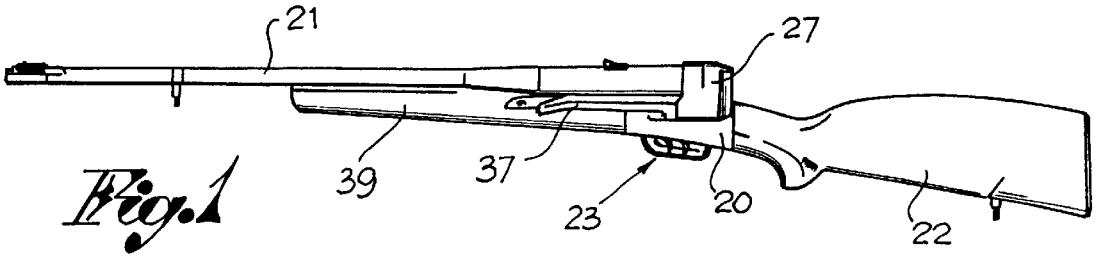
FIG. 1 is a schematic lateral view of a rifle, which may be a muzzle-loading rifle or a breech-loading rifle.

Referring to the drawings in particular, FIGS. 1–6 pertain to a muzzle-loading rifle. The rifle essentially comprises a body 20, which has a barrel 21, a butt 22, and 4O a firing device 23 with at least one trigger 24.

The barrel 21 is fixed to a receiver block 21', which is connected to the body 20 and which has a cocking mechanism 25. that will be described below. A so-called wick holder 26 for applying a trigger cap of the load placed in the barrel is provided in the rear of the barrel 21.

A rotating bolt 27 with a hand lever 28, which bolt rotates between an opening position and a closing position (FIGS. 3, 4) of the gun, respectively, for firing and reloading, is mounted in the rear part of the receiver block 21'. The rotating bolt 27 is in the form of a cap (FIGS. 2, 5 and 6), and for its opening and closing, it is screwed on an outer screw thread 29 provided around the single block 21'. The cap-type bolt 27 has in its rear part a hole 27' for the access to the wick holder and the insertion of the cap, with the hole 27' being in line with the barrel only when the bolt is in its opening position (cf. FIGS. 2, 3).

A percussion lever 30 (or firing hammer), which is actuated by the cocking mechanism 25 and is intended to strike the trigger cap at the time of firing, is mounted in the cap-type bolt 27. This lever 30 is in correspondence with the wick holder only when the bolt is in its closing position (cf. FIGS. 4 and 5).

The percussion lever 30 is oscillating on an intermediate pin 31 and has a first arm 32, which interacts with the cocking mechanism 25, and a second arm 33 for the percussion of the trigger cap. The percussion lever 30 is also stressed by a spring 34, which usually tends to keep its first arm 32 moved towards the cocking mechanism 25 and its second arm 33 far away from the wick holder.

The percussion mechanism 25 comprises a striking body 35 with a mainspring 36, and a cocking lever 37. The striking body 35 is able to make straight-line movements, and is guided in the receiver block 21' and in a tubular element 38, parallel to the barrel.

The mainspring 36 is arranged between the striking body 35 and the tubular element 38, which, moreover, is used to fix the stem 39 to the body 20.

Figure 2:
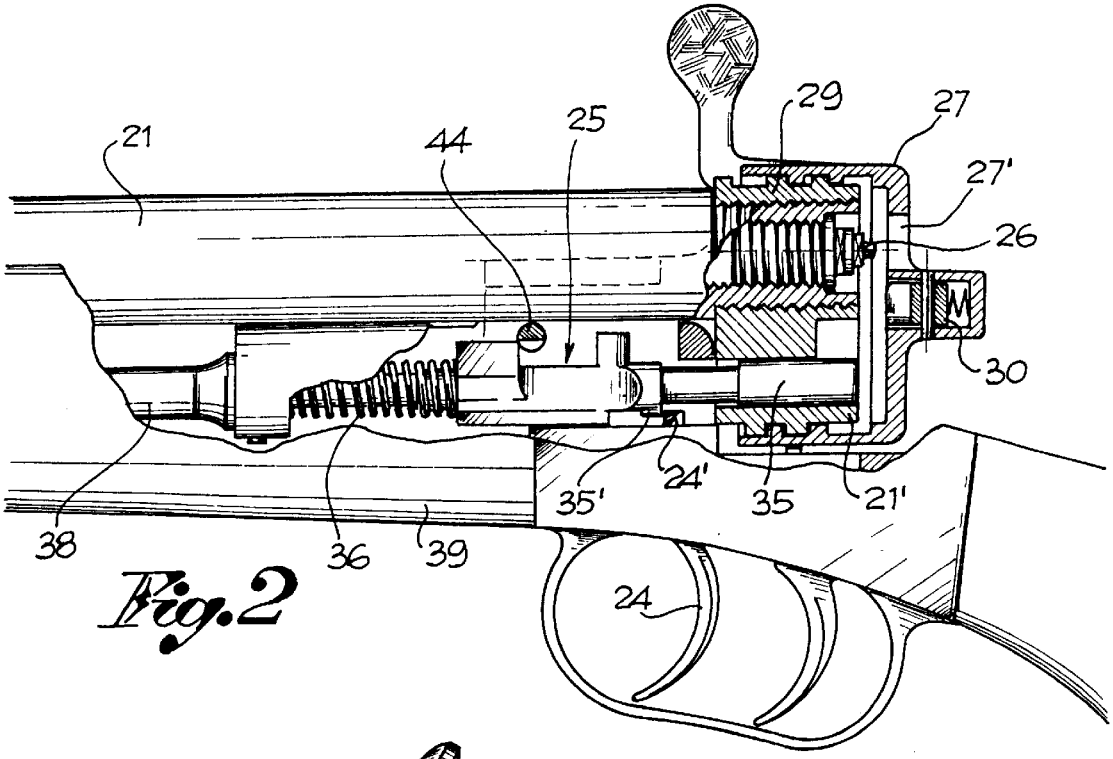
FIG. 2 is a partial and sectional view of the rifle, which is set up as a muzzleloading rifle, in the state of cocking and loading the trigger cap.
Figure 3:
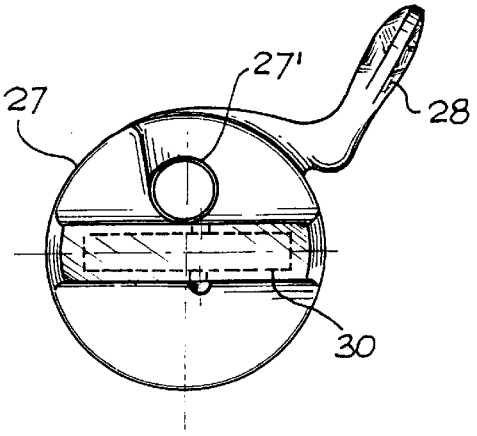
FIG. 3 is a view of the rear of the rifle in the state that is shown in FIG. 2.
Figure 4:
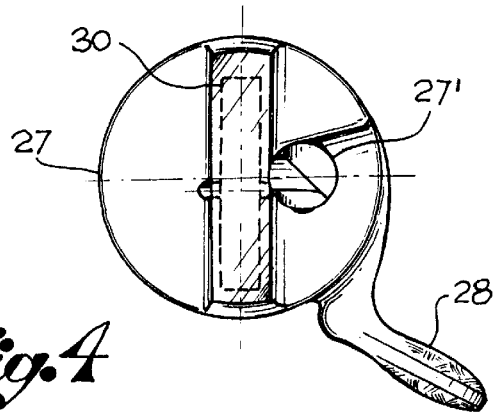
FIG. 4 is a view similar to FIG. 3, but with the rifle closed for firing.
Figure 5:
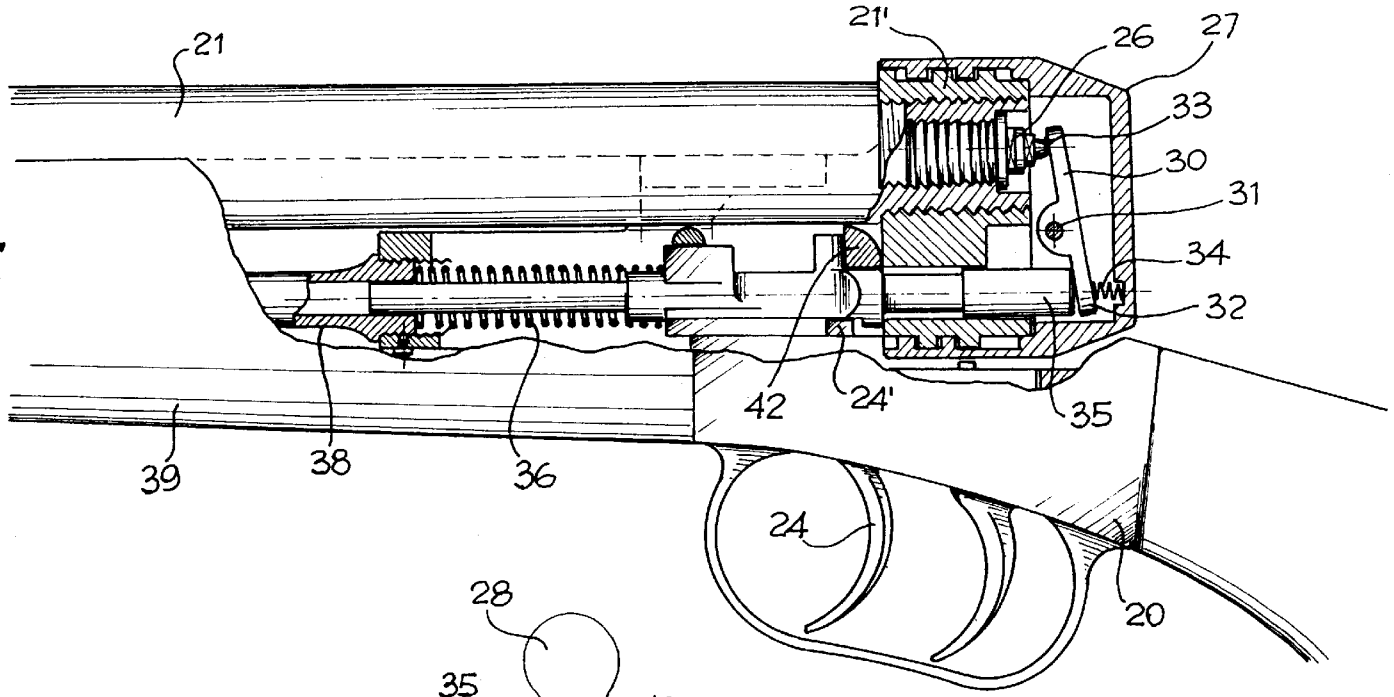
FIG. 5 is a view similar to FIG. 2, but with the rifle in the state of firing.
Figure 6:
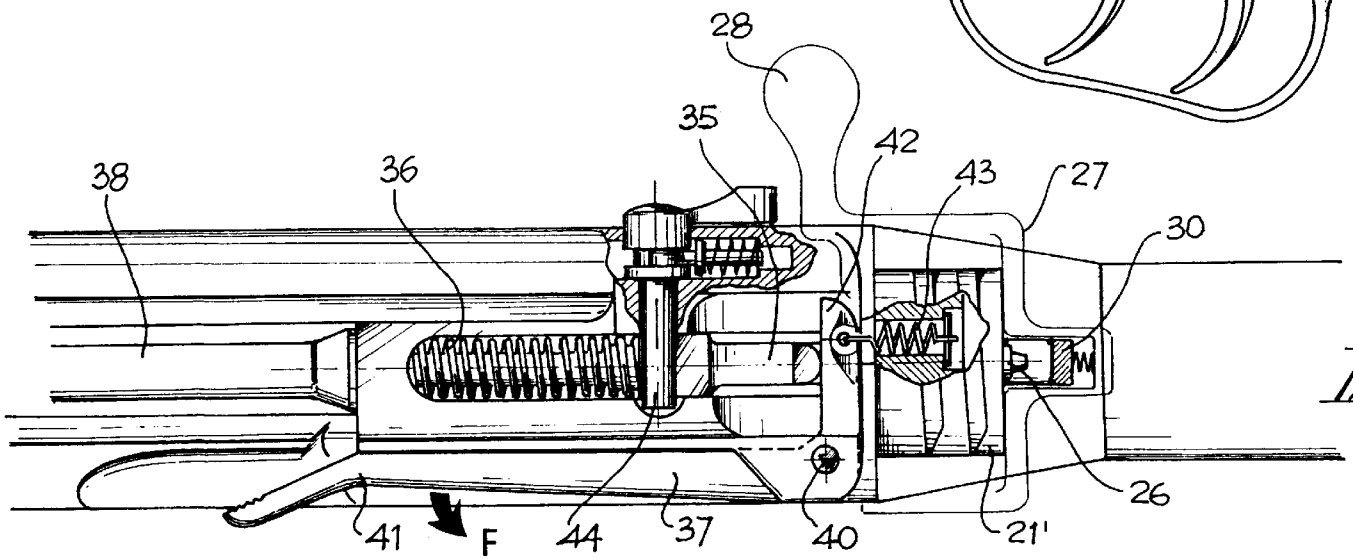
FIG. 6 is a longitudinal section of the rifle at the percussion means and the safety catch.

The striking body 35 can be moved between a position of cocking and of loading the mainspring 36, in which it is held back thanks to a shoulder 35' that engages with a nib 24' of the firing trigger 24 and a position of working on the first arm 32 of the percussion lever 30, which lever is pushed by the mainspring 36 (cf. FIGS. 2, 5).

The cocking lever 37 is used to move the striking body 35 towards its cocking position, i.e., to compress it, with the mainspring 36 loading it. This lever 37 (cf. FIG. 6) is hinged to the receiver block 21' with an intermediate pin 40 arranged in a plane at right angles to the direction of movement of the striking body 35. Said lever 37 has a grip arm 41 for its manual handling and a pushing arm 42, which is engaged and interacts with the striking body 35 for the movement of same body toward the cocking position, following a rotation of the lever according to arrow F in FIG. 6. A return spring 43, which is connected to the pushing arm 42 and to the receiver block 21', usually keeps the cocking lever rotated in a resting position, in which its grip arm 41 is brought close to the side of the block 21', and the pushing arm 42 does not have any affect on the striking body 35.

A safety catch shaft 44, known in itself and usual, which is able to block the striking body proper in the cocking position to inhibit any involuntary or accidental movement thereof toward the position of working and therefore firing, is also connected to the striking body 35.

For the use of the gun described above after having loaded the ammunition in the barrel from the front of same, the striking body 35 is cocked by means of the cocking lever 37 and the bolt 27 is rotated in its opening position (FIGS. 2 and 3) to apply the trigger cap on the wick holder through the hole 27', and then the bolt is closed again. At this point, by acting on the trigger 24, the striking body 35 is released, which, striking the first arm 32 of the percussion lever 30, causes the oscillation of this lever and the resulting percussion of its second arm 33 on the trigger cap for firing the ammunition in the barrel.

In their turn, FIGS. 7–15 illustrate the rifle set up as a breech-loading rifle, i.e., for the loading of ammunition 50 from the rear of the barrel.

In this variant thereof, the rifle keeps all the firing 23, 24, closing 27, cocking 25, percussion 30, and safety catch components of the muzzle-loading rifle, for which reason identical or similar parts are indicated in FIGS. 7–15 with the same reference numbers used in FIGS. 1–6.

The breech-loading rifle differs from the muzzle-loading rifle only by the replacement of the wick holder with a firing pin 51 on the rear of the barrel 21 and by the addition of an extractor device 52 in the rear of the receiver block 21' to extract the case of the fired cartridge from the barrel when the bolt 27 is opened, besides a different configuration of the cartridge chamber.

The bolt 27 still rotates between two positions of opening and closing and has a hole 27' for inserting the ammunition 50 in the barrel and extracting the fired case, a hole which is in line with the barrel only when the bolt is open.

The firing pin 51 is mounted in the bolt 27 and is placed in line with the barrel only with the bolt closed. The percussion lever 30 still oscillates with the first arm 32, which interacts with the cocking mechanism 25, and with the second arm, which is in line with and works on the firing pin 51. An adjusting screw 53 is coordinated at the top of this second arm in order to vary the distance of the firing pin and to adjust the percussion force.

The firing device 23, 24, the percussion mechanism 25 and the safety catch 44 are the same as described above in relation to the muzzle-loading rifle.

As for the extractor device 52, it comprises an extraction blade 54 and a stop arm 55, which are fixed at the head of an extractor shaft 56. This shaft 56 is mounted in the receiver block 21' in parallel with the barrel 21, and the extraction blade and the stop arm are enclosed in the rear of the receiver block 21' adjacent to the barrel.

The shaft 56 is able to make either axial or angular movements, together with the fixed extraction blade 54 and stop arm 55 for the passing of same from an initial position to a final position of the operation of extracting the case.

To this end, the shaft 56 is provided with a radial peg 57, which extends and engages in a cam slit 58 made on the periphery in the rotating bolt 27. The cam slit 58 (FIGS. 11 and 15) is shaped to bring about, by means of the peg 57, the axial and rotary movements of the shaft 56, and thus of the parts 54 and 55, following the closing and opening rotation of the bolt 27.

Figure 7:
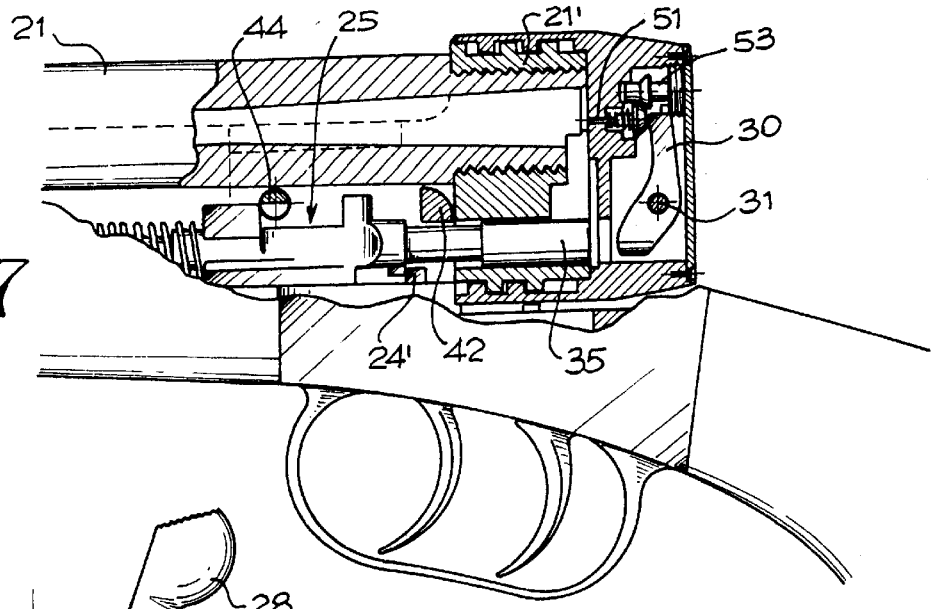
FIG. 7 is a partial and sectional view of the breech-loading variant of the rifle in the state of cocking.
Figure 9:
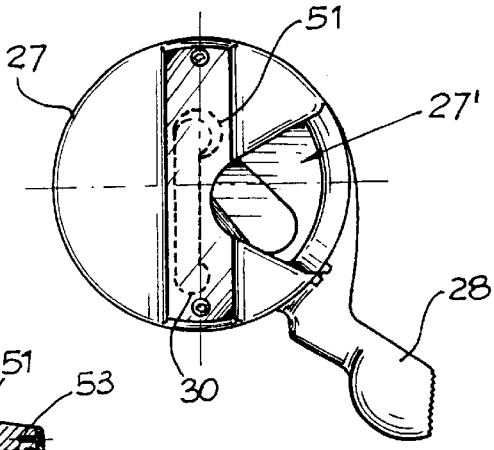
FIG. 9 is a view similar to FIG. 8, but with the bolt closed for firing the ammunition in the barrel.
Figure 10:
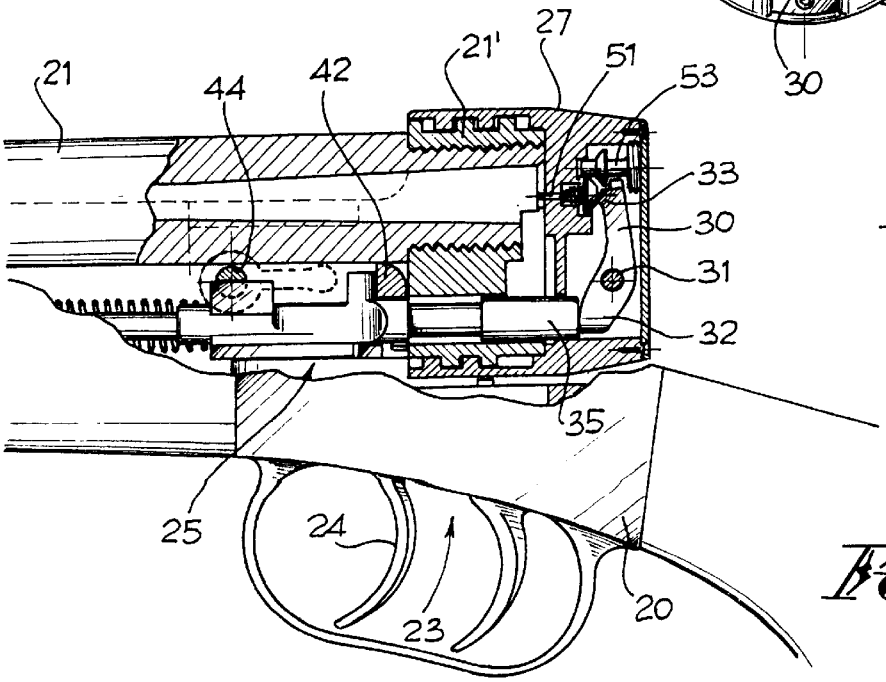
FIG. 10 is a section similar to that of FIG. 7, but of the rifle in the state of firing.
Figure 11:
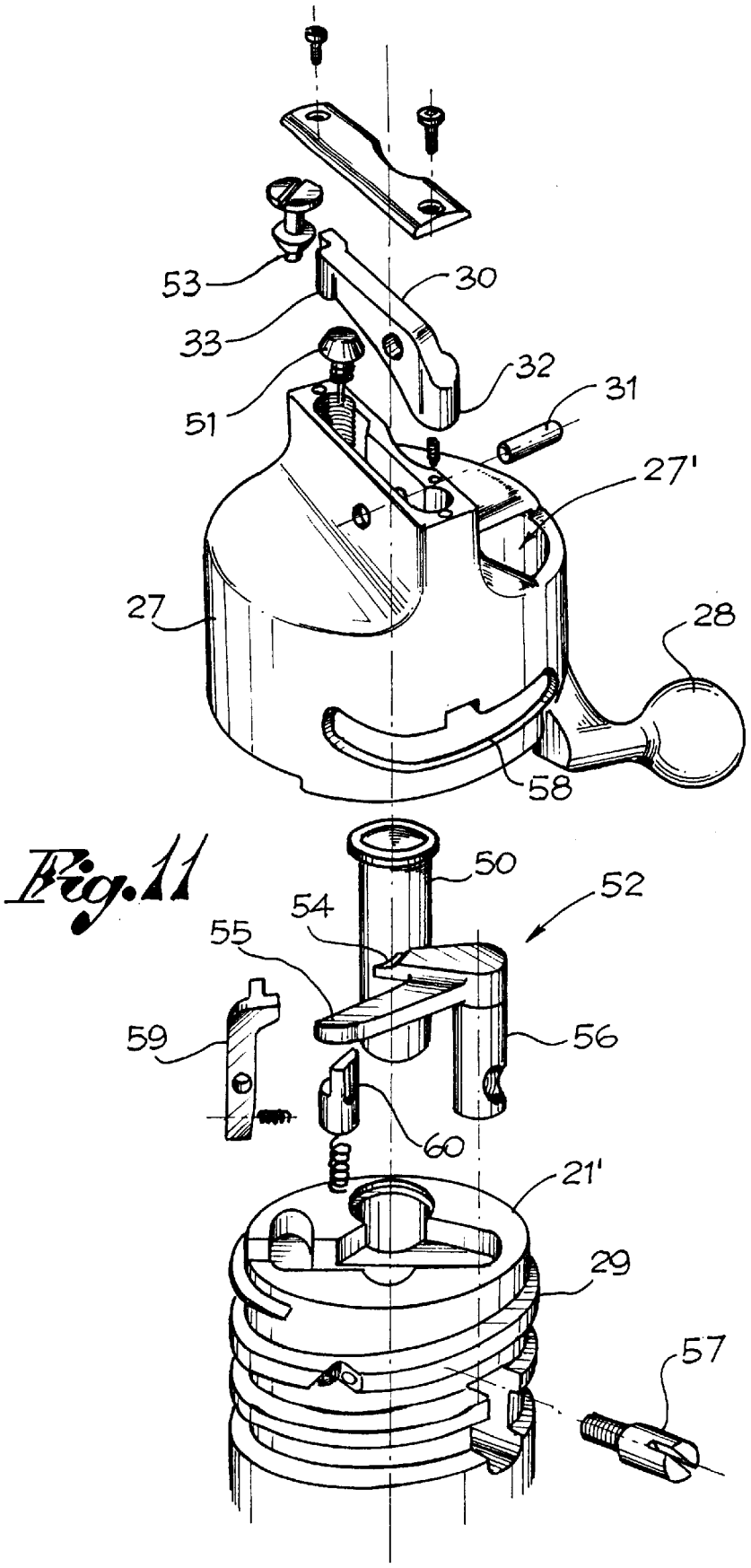
FIG. 11 is an exploded view of some of the functional components of the breech-loading rifle of FIGS. 7–10.
Figure 12:
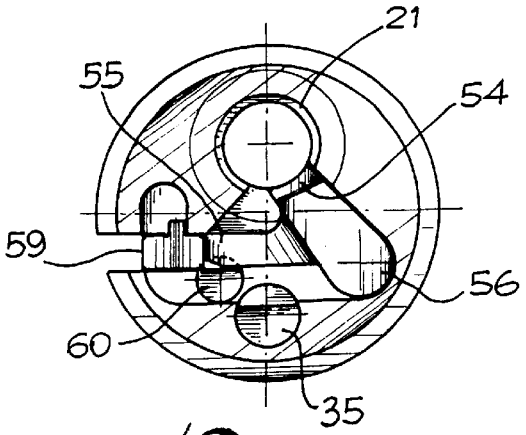
FIGS. 12 and 13 show the views of a device for extracting the cartridge case in the initial and final positions of extraction of the case, respectively.
Figure 13:
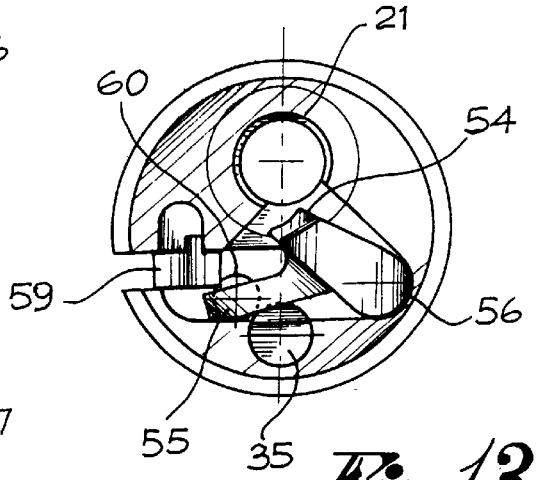
Figure 14:
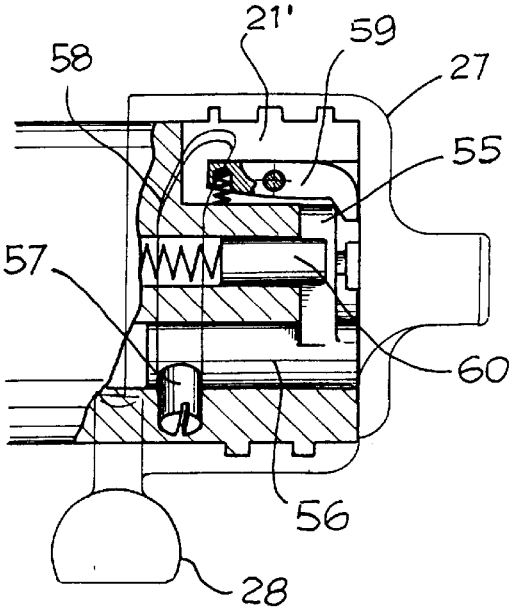
FIGS. 14 and 15 show longitudinal sections of the extractor device in the positions shown in FIGS. 12 and 13, respectively.

A spring stop catch 59, mounted in the receiver block 21', engages with the free end of the stop arm 55 to prevent the axial movement of the extractor device 52 when it is in its initial position and the bolt is closed. A spring bolt 60, which is also mounted in the receiver block 21', engages with the stop arm 55 on one side of same to prevent the rotation of the extractor device 52 when it is in its initial position and the bolt is closed. The breech-loading rifle is cocked and used like the muzzle-loading rifle, except for loading the cartridge in the barrel from the rear and firing the cartridge by means of the firing pin 51. For its part, the extractor device 52 is in its initial position when the bolt is closed and the gun is ready for use (FIGS. 7, 9). Therefore, the extraction blade 54 (FIG. 12) is arranged behind the collar of the base of the case of the cartridge 50 in the barrel, and the device is maintained in this position by the concomitant closing action of the stop catch 59 and of the bolt 60 on the stop arm 55 (FIG. 14).

Figure 8:
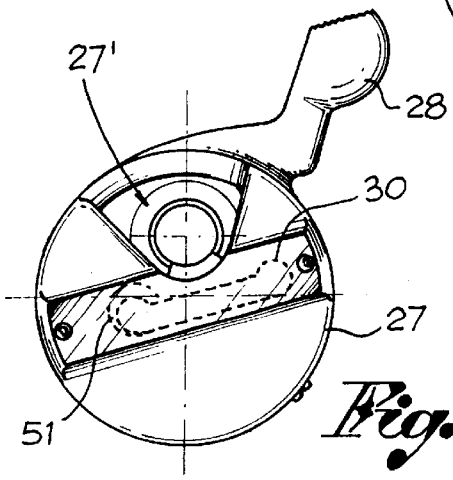
FIG. 8 is a view of the rear of the rifle with the bolt open for the insertion of ammunition into the barrel.
Figure 15:
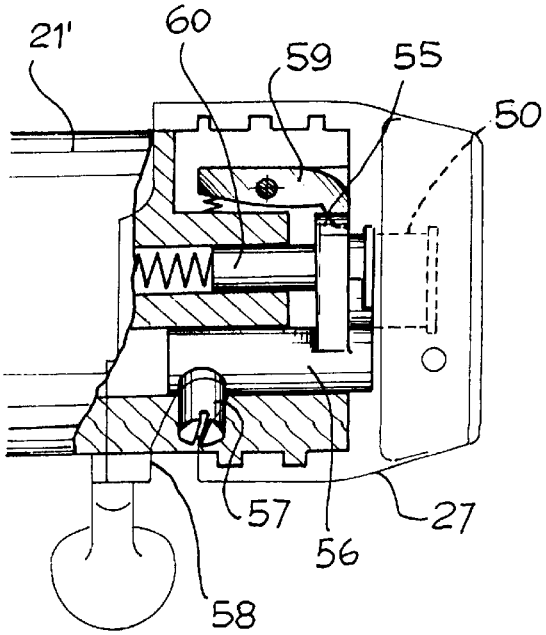

After the ammunition is fired, the bolt 27 is rotated towards its position of opening (FIG. 8). Consequently, its cam slit 58, which interacts with the peg 57, brings about an axial traverse and a rotation of the extractor shaft 56, thus forcing the stop arm 55 to avoid the closing action of the catch 59 and of the bolt 60 (FIG. 15).

Thanks to such movements made by the extraction blade 54, this extraction blade is brought to its final position and that of extracting the cartridge case from the barrel and then of releasing same so that it may be taken hold of and manually removed through the hole 27' of the bolt which is therefore in line with the barrel.

With the subsequent closing of the bolt 27 after inserting a new cartridge into the barrel, the shaft 56 rotates and traverses in opposite directions, thus automatically carrying the extraction blade 54 behind the collar of the base of the new cartridge and the stop arm 55, and engaging with the stop catch 59 and with the bolt 60.

While specific embodiments of the invention have been shown and described in detail to illustrate the application of the principles of the invention, it will be understood that the invention may be embodied otherwise without departing from such principles.

What is claimed is:

1. A rifle that may be changed between a muzzle-loading and breech-loading rifle, comprising:

a body with a butt;

a barrel having a receiver casing fixed to said body;

an opening and closing bolt for loading and firing the rifle, respectively;

a percussion mechanism adjacent to said barrel to produce the firing;

a firing device with at least one trigger fixed to said receiver casing;

a cocking mechanism cooperating with said firing device for stopping said firing device in the cocking position and for releasing said firing device in order to control said percussion mechanism, said opening and closing bolt being mounted rotating on a rear of said receiver casing and rotating between an opening position and a closing position, said percussion mechanism being mounted in said bolt and being arranged aligned with said barrel for firing when said bolt is in said closing position, and said cocking mechanism being mounted in said receiver casing in parallel with said barrel and turned towards said percussion mechanism when said percussion mechanism is in line with said barrel; and a wick holder, for setup of the rifle as a muzzle-loading rifle, in the rear of said barrel to receive a trigger cap, said rotating bolt having a hole that is arranged in line with access to said wick holder only when said bolt is in said opening position, said percussion mechanism including an oscillating lever mounted in said bolt, said oscillating lever having a first arm interacting with said cocking mechanism and a second arm for percussion on the trigger cap when said bolt is closed and said cocking mechanism is released by said trigger, and a spring biasing said lever in a position in which said second arm is away from the trigger cap.

2. A rifle that may be changed between a muzzle-loading and breech-loading rifle, comprising:

a body with a butt;

a barrel having a receiver casing fixed to said body;

an opening and closing bolt for loading and firing the rifle, respectively;

a percussion mechanism adjacent to said barrel to produce the firing;

a firing device with at least one trigger fixed to said receiver casing;

a cocking mechanism cooperating with said firing device for stopping said firing device in the cocking position and for releasing said firing device in order to control said percussion mechanism, said opening and closing bolt being mounted rotating on a rear of said receiver casing and rotating between an opening position and a closing position, said percussion mechanism being mounted in said bolt and being arranged aligned with said barrel for firing when said bolt is in said closing position, and said cocking mechanism being mounted in said receiver casing in parallel with said barrel and turned towards said percussion mechanism when said percussion mechanism is in line with said barrel; and a firing pin, for setup of the rifle as a breech-loading rifle, carried by said bolt, said firing pin being arranged in line with said barrel only when said bolt is in said closing position, in which said bolt has a hole which is arranged in line with access to said barrel when said bolt is in said opening position and in which said percussion mechanism is an oscillating lever mounted in said bolt, with said oscillating lever having a first arm interacting with said cocking mechanism and a second arm for the percussion on said firing pin when said bolt is closed and said cocking mechanism is released by said trigger and a spring biasing said lever into a position in which said second arm is away from said firing pin.

3. The rifle in accordance with claim 1, wherein said percussion mechanism comprises a striking body having a mainspring and a cocking lever, said striking body being guided in said receiver block in parallel with said barrel and being capable of straight-line movements between a position of cocking, which is defined by said firing device with said trigger, and a position of working on said first arm of said percussion lever which is pushed by said mainspring, and said cocking lever being hinged to said receiver block and having a pressing arm for its manual handling and a pushing arm which interacts with said striking body for the movement of said striking body in the position of cocking, with said cocking lever being stressed by a return spring in a position of resting and not affecting said striking body.

4. The rifle in accordance with claim 2, wherein said percussion mechanism comprises a striking body having a mainspring and a cocking lever, said striking body being guided in said receiver block in parallel with said barrel and being capable of straight-line movements between a position of cocking, which is defined by said firing device with said trigger, and a position of working on said first arm of said percussion lever which is pushed by said mainspring, and said cocking lever being hinged to said receiver block and having a pressing arm for its manual handling and a pushing arm which interacts with said striking body for the movement of said striking body in the position of cocking, with said cocking lever being stressed by a return spring in a position of resting and not affecting said striking body.

5. The rifle in accordance with the claim 2, further comprising an extractor device provided on the rear of said receiver block for an extraction of a cartridge case from said barrel after firing and following the opening of said rotating bolt.

6. The rifle in accordance with the claim 4, wherein said extractor device is provided on the rear of the said receiver block for an extraction of a cartridge case from said barrel after firing and following the opening of said rotating bolt.

7. The rifle in accordance with claim 5, wherein said extractor device comprises an extraction blade and a stop arm, said extraction blade and said stop arm being fixed to an extractor shaft and said extractor shaft being mounted in said receiver block in parallel with said barrel and being axially and rotationally moveable following a rotation of said bolt between said opening position and said closing position, with said shaft having a radial peg engaging with a cam slit provided in said bolt and shaped to move said extractor device in a direction of extracting the case from said barrel with said extraction blade when said bolt is opened and bringing said extraction blade forward to engage behind a base of the case when said extractor is closed.

8. The rifle in accordance with claim 6, wherein said extractor device comprises an extraction blade and a stop arm, said extraction blade and said stop arm being fixed to an extractor shaft and said extractor shaft being mounted in said receiver block in parallel with said barrel and being axially and rotationally moveable following a rotation of said bolt between said opening position and said closing position with said shaft having a radial peg engaging with a cam slit provided in said bolt and shaped to move said extractor device in a direction of extracting the case from said barrel with said extraction blade when said bolt is opened and bringing said extraction blade forward to engage behind a base of the case when said extractor is closed.

9. The rifle in accordance with claim 7, wherein said extractor device is held back in an initial position of extracting the case by a spring catch mechanism engaging with said stop arm.

10. A rifle, comprising:

a body with a butt;

a barrel having a receiver casing fixed to said body;

an opening and closing bolt for loading and firing the rifle, respectively;

a percussion mechanism to produce the firing, said percussion mechanism being mounted to said bolt, said bolt being mounted rotating on a rear of said receiver casing and rotating between an opening position and a closing position in which said percussion mechanism is aligned with said barrel for firing;

a firing device with at least one trigger fixed to said receiver casing;

a cocking mechanism cooperating with said firing device for stopping said firing device in the cocking position and for releasing said firing device in order to control said percussion mechanism, said cocking mechanism being mounted in said receiver casing in parallel with said barrel and turned towards said percussion mechanism when said percussion mechanism is in line with said barrel;

and further comprising one of:

a wick holder, for setup of the rifle as a muzzle-loading rifle, in the rear of said barrel to receive a trigger cap, wherein said rotating bolt has a hole that is arranged in line with access to said wick holder only when said bolt is in said opening position, and wherein said percussion mechanism includes an oscillating lever mounted in said bolt, said oscillating lever having a first arm interacting with said cocking mechanism and a second arm for percussion on the trigger cap when said bolt is closed and said cocking mechanism is released by said trigger, and a spring biasing said lever in a position in which said second arm is away from the trigger cap or a firing pin, for setup of the rifle as a breech-loading rifle, carried by said bolt, wherein said firing pin is arranged in line with said barrel only when said bolt is in said position of closing, in which said bolt has a hole which is arranged in line with access to said barrel when said bolt is in said position of opening and in which said percussion mechanism is an oscillating lever mounted in said bolt, with said oscillating lever having a first arm interacting with said cocking mechanism and a second arm for the percussion on said firing pin when said bolt is closed and said cocking mechanism is released by said trigger and a spring biasing said lever into a position in which said second arm is away from said firing pin.

11. The rifle in accordance with claim 10, wherein said percussion mechanism comprises a striking body having a mainspring and a cocking lever, said striking body being guided in said receiver block in parallel with said barrel and being capable of straight-line movements between a position of cocking, which is defined by said firing device with said trigger, and a position of working on said first arm of said percussion lever which is pushed by said mainspring, and said cocking lever being hinged to said receiver block and having a pressing arm for its manual handling and a pushing arm which interacts with said striking body for the movement of said striking body in the position of cocking, with said cocking lever being stressed by a return spring in a position of resting and not affecting said striking body.

12. The rifle in accordance with the claim 11, further comprising an extractor device provided on the rear of said receiver block for an extraction of a cartridge case from said barrel after firing and following the opening of said rotating bolt.

13. The rifle in accordance with the claim 12, wherein said extractor device is provided on the rear of the said receiver block for an extraction of a cartridge case from said barrel after firing and following the opening of said rotating bolt.

14. The rifle in accordance with claim 13, wherein said extractor device comprises an extraction blade and a stop arm, said extraction blade and said stop arm being fixed to an extractor shaft and said extractor shaft being mounted in said receiver block in parallel with said barrel and being axially and rotationally moveable following a rotation of said bolt between said opening position and said closing position, with said shaft having a radial peg engaging with a cam slit provided in said bolt and shaped to move said extractor device in a direction of extracting the case from said barrel with said extraction blade when said bolt is opened and bringing said extraction blade forward to engage behind a base of the case when said extractor is closed.

15. The rifle in accordance with claim 14, wherein said extractor device comprises an extraction blade and a stop arm, said extraction blade and said stop arm being fixed to an extractor shaft and said extractor shaft being mounted in said receiver block in parallel with said barrel and being axially and rotationally moveable following a rotation of said bolt between said opening position and said closing position, with said shaft having a radial peg engaging with a cam slit provided in said bolt and shaped to move said extractor device in a direction of extracting the case from said barrel with said extraction blade when said bolt is opened and bringing said extraction blade forward to engage behind a base of the case when said extractor is closed.

16. The rifle in accordance with claim 15, wherein said extractor device is held back in an initial position of extracting the case by a spring catch mechanism engaging with said stop arm.

17. A rifle, comprising:

a body with a butt;

a barrel having a receiver casing fixed to said body;

an opening and closing bolt for loading and firing the rifle, respectively;

a percussion mechanism to produce the firing, said percussion mechanism being mounted to said bolt, said bolt being mounted rotating on a rear of said receiver casing and rotating between an opening position and a closing position in which said percussion mechanism is aligned with said barrel for firing;

a firing device with at least one trigger fixed to said receiver casing;

a cocking mechanism cooperating with said firing device for stopping said firing device in the cocking position and for releasing said firing device in order to control said percussion mechanism, said cocking mechanism being mounted in said receiver casing in parallel with said barrel and turned towards said percussion mechanism when said percussion mechanism is in line with said barrel; and a wick holder, for setup of the rifle as a muzzle-loading rifle, in the rear of said barrel to receive a trigger cap, said rotating bolt having a hole that is arranged in line with access to said wick holder only when said bolt is in said opening position, said percussion mechanism including an oscillating lever mounted in said bolt, said oscillating lever having a first arm interacting with said cocking mechanism and a second arm for percussion on the trigger cap when said bolt is closed and said cocking mechanism is released by said trigger, and a spring biasing said lever in a position in which said second arm is away from the trigger cap.

18. A rifle, comprising:

a body with a butt;

a barrel having a receiver casing fixed to said body;

an opening and closing bolt for loading and firing the rifle, respectively;

a percussion mechanism to produce the firing, said percussion mechanism being mounted to said bolt, said bolt being mounted rotating on a rear of said receiver casing and rotating between an opening position and a closing position in which said percussion mechanism is aligned with said barrel for firing;

a firing device with at least one trigger fixed to said receiver casing;

a cocking mechanism cooperating with said firing device for stopping said firing device in the cocking position and for releasing said firing device in order to control said percussion mechanism; said cocking mechanism being mounted in said receiver casing in parallel with said barrel and turned towards said percussion mechanism when said percussion mechanism is in line with said barrel; and a firing pin, for setup of the rifle as a breech-loading rifle, carried by said bolt, said firing pin being arranged in line with said barrel only when said bolt is in said closing position, in which said bolt has a hole which is arranged in line with access to said barrel when said bolt is in said opening position and in which said percussion mechanism is an oscillating lever mounted in said bolt, with said oscillating lever having a first arm interacting with said cocking mechanism and a second arm for the percussion on said firing pin when said bolt is closed and said cocking mechanism is released by said trigger and a spring biasing said lever into a position in which said second arm is away from said firing pin.

* * * * *